United States Patent [19]

Wemyss

[11] 4,235,059

[45] Nov. 25, 1980

[54] JOINT

[76] Inventor: George A. Wemyss, 12 Regis Ct., Whitehouse Rd., Barnton, Edinburgh EH3 6RG, Scotland

[21] Appl. No.: 899,457

[22] Filed: Apr. 24, 1978

[30] Foreign Application Priority Data

May 4, 1977 [GB] United Kingdom ..... 18700/77

[51] Int. Cl.[3] ..... E04C 3/30

[52] U.S. Cl. ..... 52/721; 403/217; 403/176

[58] Field of Search ..... 52/721, 648, 80, 81, 52/726; 403/217, 175, 174, 176, 344, 406, 407, 171, 172, 173, 293, 292, 306, 312, 338

[56] References Cited

U.S. PATENT DOCUMENTS

| | | | |
|---|---|---|---|
| 1,685,696 | 9/1928 | Frank | 403/175 |
| 3,560,029 | 2/1971 | Floyd, Jr. | 403/312 X |
| 3,572,223 | 3/1971 | Vierregger | 403/338 X |
| 3,727,362 | 4/1973 | Ellison et al. | 403/174 X |
| 3,829,999 | 12/1974 | Bernstein | 52/648 X |
| 3,942,297 | 3/1976 | Kitagawa | 52/726 X |
| 4,099,888 | 7/1978 | Simone | 52/81 X |

FOREIGN PATENT DOCUMENTS

| | | |
|---|---|---|
| 476429 | 12/1937 | United Kingdom . |
| 983320 | 2/1965 | United Kingdom . |

*Primary Examiner*—Carl D. Friedman

*Attorney, Agent, or Firm*—Neil F. Markva

[57] ABSTRACT

A joint for connecting together three generally tubular members comprises first and second members and a clamp for joining the two joint members together. Each of the joint members has first and second portions, the first portion of each joint member being a telescopic fit within a respective one of the tubular members. The second portions of the two joint members together form a connector when the joint members are juxtaposed. The clamp is effective to pass around the two second portions of the juxtaposed joint members to fix the connector for coupling a third tubular member.

19 Claims, 3 Drawing Figures

JOINT

BACKGROUND OF THE INVENTION

This invention relates to a joint for connecting together at least three generally elongate structural members.

My co-pending U.S. Patent Application Ser. No. 850,252 relates to building structures of the type having a framework covered by sheet material. The framework of these building structures is made up of a large number of generally tubular members, and it is the aim of this invention to provide a joint for connecting at least three such members and which is easy to manufacture and to use.

SUMMARY OF THE INVENTION

The present invention provides a joint for connecting together three generally tubular members. The joint comprises first and second members and a clamp for joining the two joint members together with each joint member having first and second portions. The first portion of each joint member is a telescopic fit within a respective one of the tubular members. The second portions of the two joint members together form a connector when the joint members are juxtaposed for joining to the third tubular member. The clamp passes around the two second portions of the joint members and is coupled to the third tubular member.

Each of the first portions may be arranged to be a friction fit within its respective tubular member, but it is preferable for the first portions to be welded or riveted to their tubular members.

Preferably, each of the joint members has a third portion, the two third portions together forming a connector for a fourth generally tubular member. A second clamp may, in this case, be provided for joining the two joint members together, the second clamp passing round the two third portions.

Advantageously, the two first portions extend generally in opposite directions and the second (and where provided the third) portions extend substantially at right-angles thereto.

The connector formed by the two second portions may be joined to the third tubular member by means of a nut and bolt. Preferably, the bolt passes through the first-mentioned clamp, through the adjoining regions of the second portions, and through a flattened end portion of the third tubular member. Advantageously, the non-threaded end of the shank of the bolt is of square cross-section, and a hole provided in the clamp is of similar cross-section.

The connector formed by the two third portions is preferably joined to the fourth tubular member in the same way.

In practice, the tubular members to be joined together are each in the form of a compound-braced strut having first and second parallel tubular booms braced together by a series of cross-pieces. In this case, the first booms of the struts are joined together by a first joint, and the second booms of the struts are joined together by a second joint, the first and second joints being of the type defined above. Preferably, the two first members of the first and second joints are joined together by a strut, and the two second members of the first and second jointed are joined together by a further strut. These struts increase the rigidity of the joints.

Advantageously, the parts of the joint are made of a high strength aluminium alloy.

BRIEF DESCRIPTION OF THE DRAWINGS

The invention will now be described in greater detail by way of example, with reference to the accompanying drawings, in which.

DESCRIPTION OF PREFERRED EMBODIMENT

Figure 1:
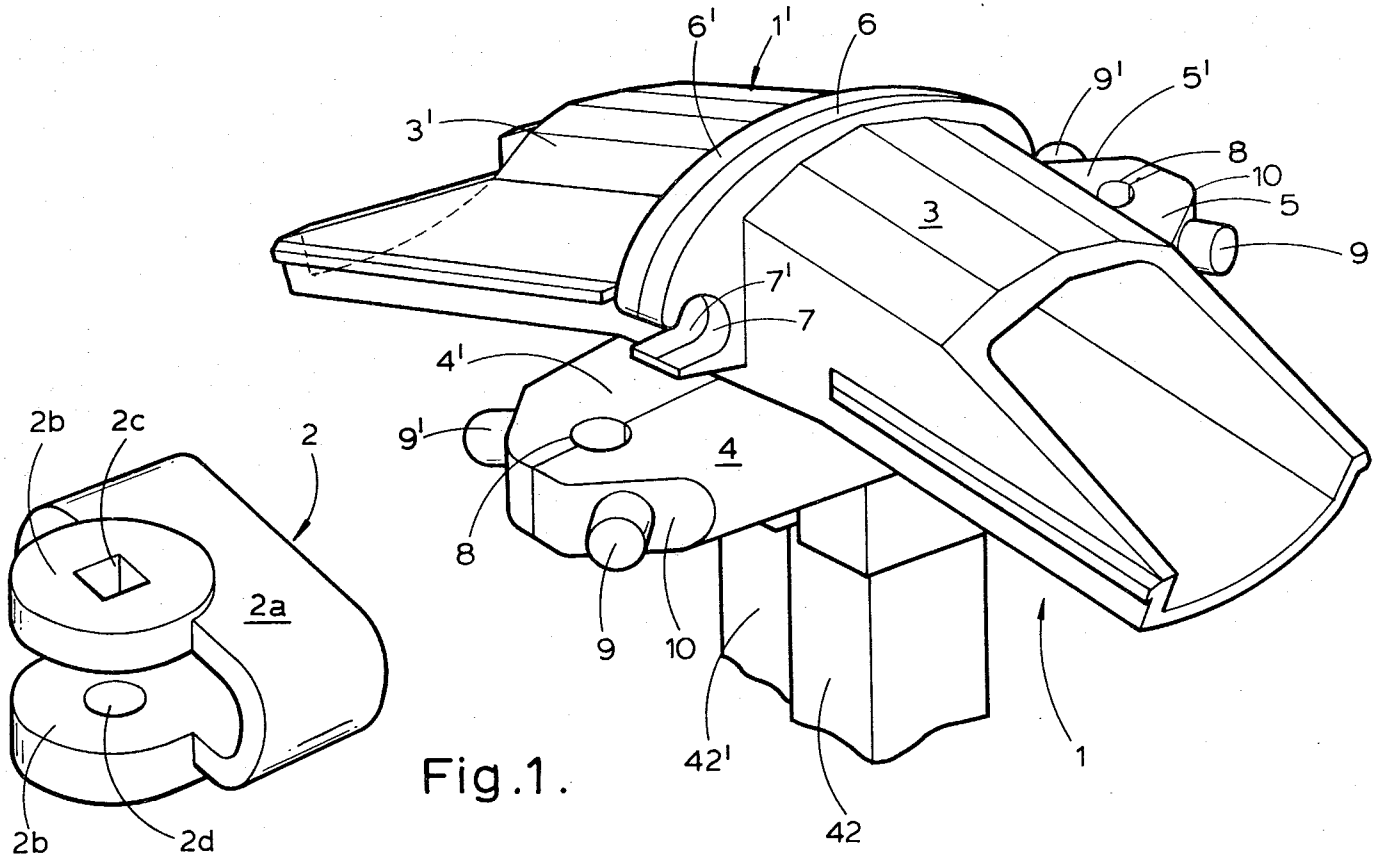
FIG. 1 is a perspective view of a joint constructed in accordance with the invention.

Referring to the drawings, FIG. 1 shows a joint comprising first and second joint members 1 and 1' and a clamp 2. All the parts of the joint are made from a high strength aluminium alloy. Members 1 and 1' are identical, each having a first connector portion 3 and 3' respectively, a second connector portion 4 and 4' respectively, and a third connector portion 5 and 5' respectively. In each case, the second and third connector portions 4 and 4' and 5 and 5' extend at right angles to the corresponding first connector portions 3 and 3'. Each first connector portion 3 and 3' includes an outwardly extending flange 6 and 6' which, when juxtaposed in use, lie in face-to-face engagement as shown in FIG. 1. A re-entrant aperture 7 and 7' is located at each lateral edge portion of flange 6 and 6', respectively. The purpose of apertures 7 and 7' is described below.

As shown in FIG. 1, the two second portions 4 and 4' together form a tab which extends generally perpendicularly to the plane of symmetry of the joint which passes through the center of the first connector portions 3 and 3'. A semi-circular aperture located in each second connector portion 4 and 4' forms a circular aperture 8 when the two members 1 and 1' are positioned as shown in FIG. 1. Each second connector portion 4 and 4' includes a short dowel 9 and 9' which extends outwardly from an inclined front face 10 and 10'. The purpose of these dowels 9 and 9' is explained below.

The two third connector portions 5 and 5' are identical to the two second connector portions 4 and 4' and so define a circular aperture 8 and have dowels 9 and 9'.

Clamp 2 includes a generally flattened-oval body portion 2*a* and a pair of generally disc-shaped members 2*b* which project beyond the edge of the body portion as shown in FIG. 1. One of the members 2*b* includes a square hole 2*c* and the other has a circular hole 2*d*. The two holes 2*c* and 2*d* are aligned and spaced from the edge of body portion 2*a*. In use, clamp 2 fits over the second connector portions 4 and 4', to connect the members 1 and 1' together in a manner to be described below. A second, identical clamp (not shown) fits over the third connector portions 5 and 5'.

Figure 2:
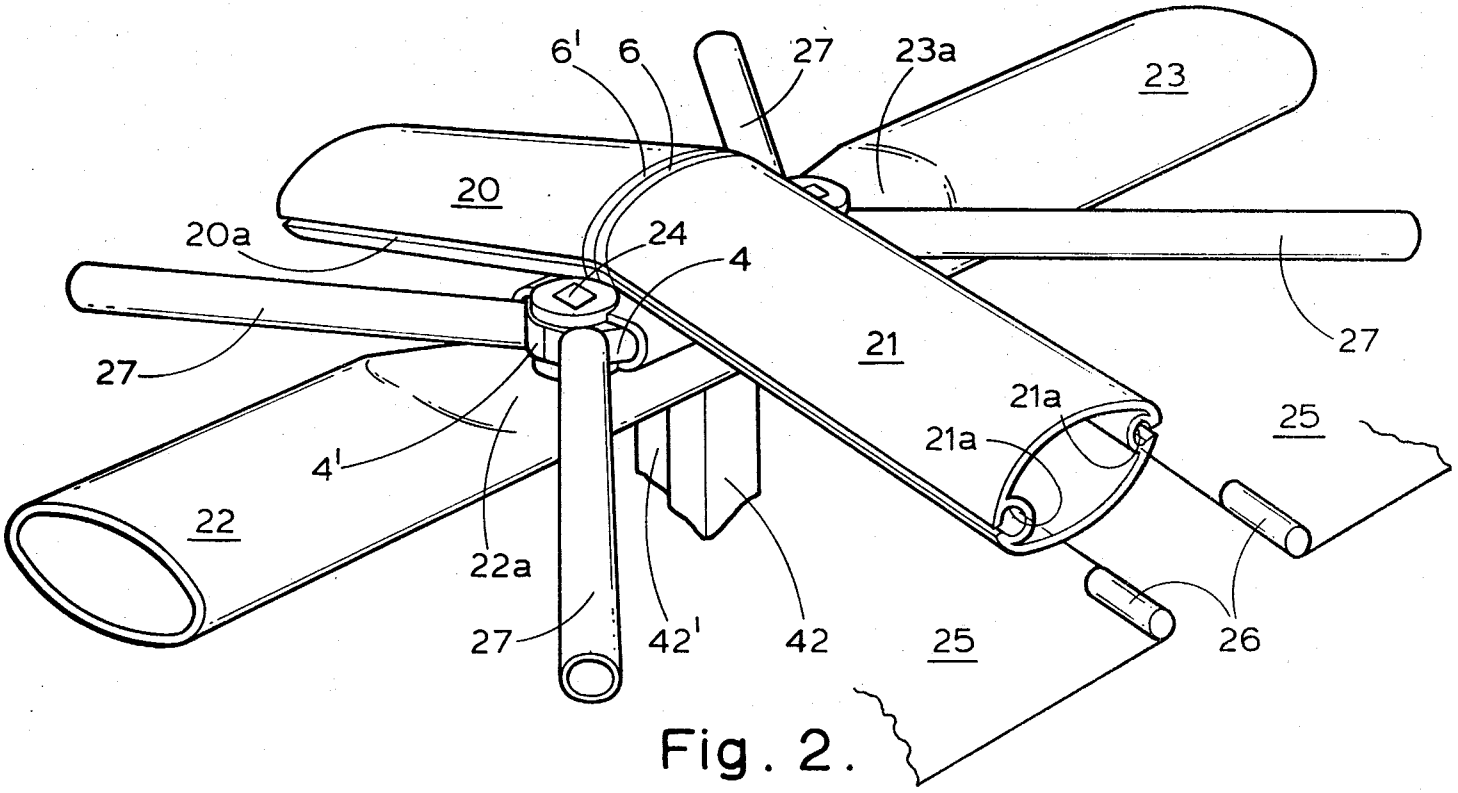
FIG. 2 is a perspective view of four tubular members connected together by the joint of FIG. 1.

The joint described above with reference to FIG. 1 is used to join together four generally tubular members in the manner described below with reference to FIGS. 2 and 3. Each tubular member 20, 21, 22 and 23 is of generally elliptical cross-section. Members 20 and 21 slide over first portions 3 and 3' of joint members 1 and 1' until their end faces meet flanges 6 and 6'. Members 20 and 21 each have a pair of re-entrant grooves 20*a* and 21*a* which form a continuous groove with aperture 7 and 7' of flanges 6 and 6'. Members 20 and 21 are riveted to first portions 3 and 3' so as to form a permanent connection.

Figure 3:
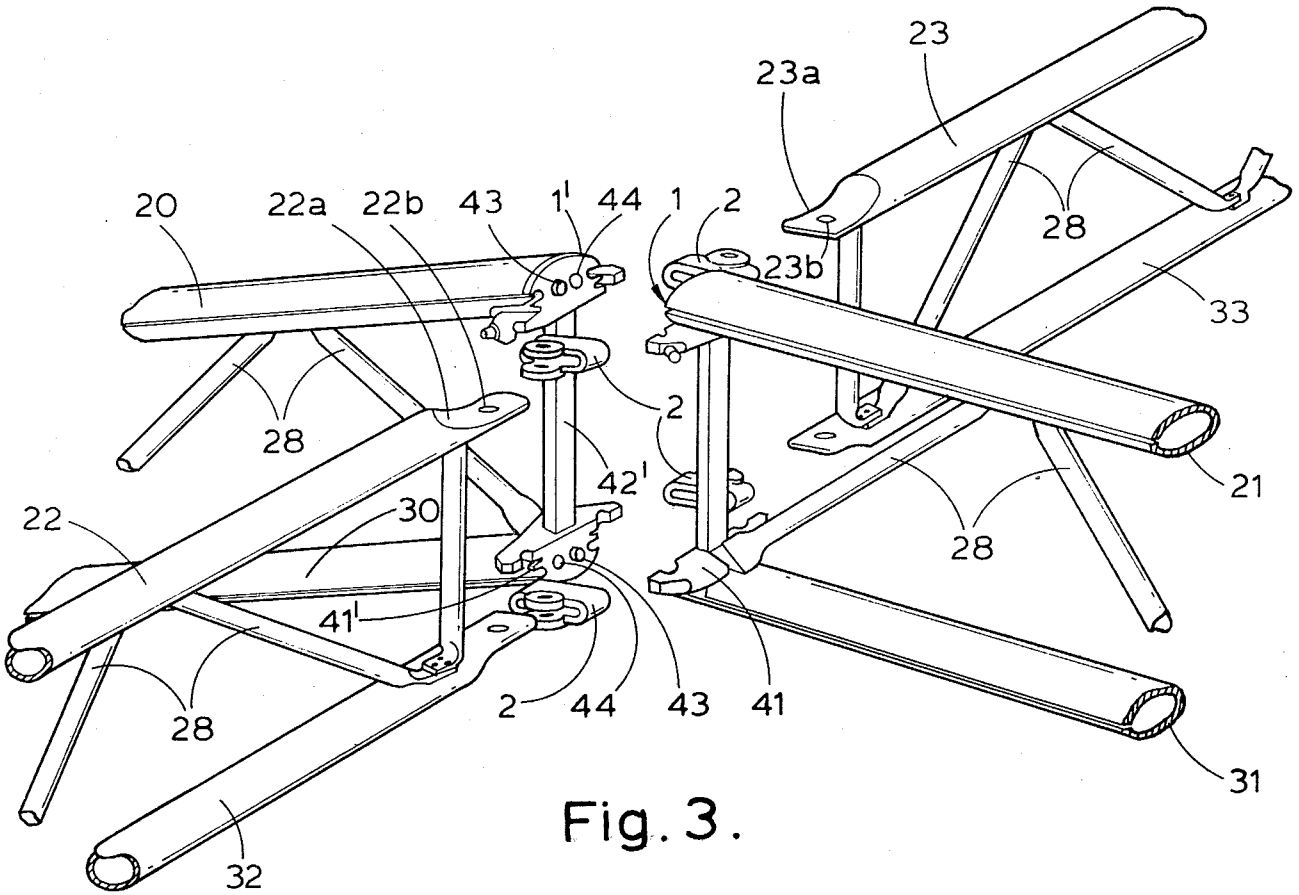
FIG. 3 is a perspective view of four compound-braced struts prior to being joined together by means of joints of the type shown in FIG. 1.

Member 22 includes a flattened end portion 22*a* having a hole 22*b* (see FIG. 3). Clamp 2 is placed over second portions 4 and 4' of joint members 1 and 1'. A bolt 24 having a square-ended shank portion is pulled through square hole 2*c* in clamp 2, through hole 8 in the tab formed by second portions 4 and 4', through round hole 2*d* in clamp 2 and through round hole 22*b* in the flattened end portion 22*a* of tubular member 22. A nut (not shown) can then be threaded onto bolt 24 and tightened up to secure member 22 to the joint, thus firmly connecting the two joint members 1 and 1' at the same time.

Member 23 is identical to member 22, having a flattened end portion 23*a* and a bolt hold 23*b*, and it is connected to the joint in an identical manner. Thus, four tubular members 20, 21, 22 and 23 can be firmly connected together in a very simple manner, using two nuts and bolts and a simple riveting operation. Where the joint is not required to be permanent, the riveting step can be omitted and members 20 and 21 can be arranged to be friction fitted to the first portions 3 and 3'. The use of bolts 24 having square-ended shanks, enables the nuts to be tightened up without the need for the operator to hold the shank of the bolt to prevent it rotating with the nut.

As indicated above, the joints are intended particularly for use with the type of building structure described in the specification of my copending U.S. Patent Application Ser. No. 850,252. This specification describes how the sheet material which forms the covering for the framework made up from tubular members such as 20, 21, 22 and 23 is fixed to these members. Briefly, sheets 25 of material are provided at each lateral edge with a beading 26 which can slide in grooves 20*a* and 21*a* and by apertures 7 and 7'. In order to stretch the sheets 25, rails 27 may criss-cross diagonally between the tubular members and bow slightly outwardly. Rails 27 in FIG. 2 are friction fitted over dowels 9 and 9' of joint members 1 and 1'. Where rails 27 are not needed, dowels 9 and 9' of joint members 1 and 1' can be omitted.

In the specification of my co-pending U.S. Patent Application Ser. No. 850,252, the members forming the framework of the building structure are compound-braced booms and FIG. 3 shows how such booms are joined together using the type of joint shown in FIG. 1. Basically, each of the compound-braced booms includes a pair of tubular booms 20 and 30, 21 and 31, 22 and 32, and 23 and 33, the booms of each pair being braced together by struts 28. The four booms 20, 21, 22 and 23 are joined together by a joint identical to that of FIG. 1. Booms 30, 31, 32 and 33, are joined together by a second joint which has joint members 41 and 41' identical to members 1 and 1' apart from the omission of dowels 9 and 9' which are unnecessary as no sheet material is passed over booms 30, 31, 32 and 33. Joint members 1 and 41 are connected by a strut 42, and joint members 1' and 41' are connected by a strut 42', these struts increasing the rigidity of the finished compound joint.

FIG. 3 also shows a further feature of the invention, namely that the end faces of joint members 1 and 1', 41 and 41' each include a peg 43 and a matching hole 44, the peg of one member mates with the hole of its counterpart and vice-versa. In this way, accurate alignment of the pairs of joint members is facilitated and ensured.

It will be apparent, therefore, that the joint described above enables the tubular members of the framework of a building structure to be joined together in a simple and reliable manner. Moreover, each joint merely requires two standard bolts (and associated nuts) and a conventional riveting gun (where the joints are required to be permanent).

I claim:

1. A joint for connecting together tubular members, said joint comprising:

(a) first and second members and a clamp for holding the two joint members together, (b) each joint member includes a first portion having a structure effective for a telescopic fit within a respective one of each tubular member, and a second portion extending outwardly from the first portion, (c) the second portions of each joint member together forming a connector when the joint members are juxtaposed, (d) said clamp being effective to pass around the two second portions of the juxtaposed joint members to hold said second portions together to form said connector, (e) threaded means for coupling a third tubular member, (f) said threaded means passing through the clamp and the connector and being effective to fix the clamp to the two second portions of the juxtaposed joint members whereby the two joint members are securely fixed to one another.

2. A joint as defined in claim 1, wherein each first portion is effective to be friction fit within its respective tubular member.

3. A joint as defined in claim 1, wherein each first portion is welded or riveted to its respective tubular member.

4. A joint as defined in claim 1, wherein each joint member includes a third portion, the two third portions together forming a second connector for a fourth generally tubular member when the joint members are juxtaposed.

5. A joint as defined in claim 4, wherein a second clamp is effective to pass around the two third portions of the juxtaposed joint members to fix the second connector for coupling the fourth tubular member.

6. A joint for connecting together tubular members, said joint comprising:

(a) first and second members and a clamp for holding the two joint members together, (b) each joint member includes a first portion having a structure effective for a telescopic fit within a respective one of the tubular members, and a second portion extending outwardly from the first portion, (c) the second portions of each joint member together forming a connector when the joint members are juxtaposed, (d) said clamp being effective to pass around the two second portions of the juxtaposed joint members to fix the connector for coupling a third tubular member, (e) each joint member includes a third portion, the two third portions together forming a second connector for a fourth generally tubular member when the joint members are juxtaposed, another strut connects the second joint member of the first joint to the fourth joint member of the second joint.

18. A joint assembly for joining together four tubular members composed of a compound-braced strut including first and second parallel tubular booms braced together by a series of cross pieces, said joint assembly comprising:

(a) a first joint to join together the first booms of the struts, (b) a second joint to join together the second booms of the struts, (c) the first joint including first and second joint members and first and second clamps for holding the first and second joint members together, (d) each of the first and second joint members having first, second and third portions, (e) the first portion of each of the first and second joint members being a telescopic fit within a respective one of the first booms of the first and second struts, (f) the second portions of the first and second joint members together form a first connector when said first and second joint members are juxtaposed for joining to the first boom of the third strut, (g) the first clamp is effective to pass around the second portions of the first and second joint members, (h) the third portions of the first and second joint members together forming a second connector when said first and second joint members are juxtaposed for joining to the first boom of the fourth strut, (i) the second clamp is effective to pass around the third portions of the first and second joint members, (j) the second joint including third and fourth joint members and third and fourth clamps for joining the third and fourth joint members together, (k) each of the third and fourth joint members having first, second and third portions, (l) the first portion of each of the third and fourth joint members being a telescopic fit within a respective one of the second booms of the first and second struts, (m) the second portions of the third and fourth joint members together form a third connector when the third and fourth joint members are juxtaposed for joining to the second boom of the third strut, (n) the third clamp is effective to pass through the two second portions of the third and fourth joint members, (o) the third portions of the third and fourth joint members together form a fourth connector when the third and fourth joint members are juxtaposed for joining to the second boom of the fourth strut, (p) the fourth clamp is effective to pass around the third portions of the third and fourth joint members.

19. A joint as defined in claim 18, wherein a strut connects the first joint member of the first joint to the third joint member, and another strut connects the second joint member of the first joint to the fourth joint member.

* * * * *

(f) the two first portions extend in generally opposite directions, and (g) the second portions extend substantially at right-angles with respect to the first portions.

7. A joint as defined in claim 6, wherein the third portions extend substantially at right-angles to the two first portions, and generally in opposite directions to the second portions.

8. A joint for connecting together tubular members, said joint comprising:

(a) first and second members and a clamp for holding the two joint members together, (b) each joint member includes a first portion having a structure effective for a telescopic fit within a respective one of the tubular members, and a second portion extending outwardly from the first portion, (c) the second portions of each joint member together forming a connector when the joint members are juxtaposed, (d) said clamp being effective to pass around the two second portions of the juxtaposed joint members to fix the connector for coupling a third tubular member, and (e) the two first portions extend in generally opposite directions, and the second portions extend substantially at right-angles with respect to the first portions.

9. A joint for connecting together tubular members, said joint comprising:

(a) first and second members and a clamp for holding the two joint members together, (b) each joint member includes a first portion having a structure effective for a telescopic fit within a respective one of the tubular members, and a second portion extending outwardly from the first portion, (c) the second portions of each joint member together forming a connector when the joint members are juxtaposed, (d) said clamp being effective to pass around the two second portions of the juxtaposed joint members to fix the connector for coupling a third tubular member, and (e) a nut and bolt joins the connector formed by the two second portions to the third tubular member.

10. A joint as defined in claim 9, wherein said bolt passes through said clamp disposed around the second portions, through the adjoining regions of the second portions, and through a flattened end portion of the third tubular member.

11. A joint as defined in claim 10, wherein the bolt has a shank with a non-threaded end having a square cross-section, and said clamp has a hole with a cross-section similar to said bolt.

12. A joint for connecting together tubular members, said joint comprising:

(a) first and second members and a clamp for holding the two joint members together, (b) each joint member includes a first portion having a structure effective for a telescopic fit within a respective one of the tubular members, and a second portion extending outwardly from the first portion, (c) the second portions of each joint member together forming a connector when the joint members are juxtaposed, (d) said clamp being effective to pass around the two second portions of the juxtaposed joint members to fix the connector for coupling a third tubular member, (e) each joint member includes a third portion, the two third portions together forming a second connector for a fourth generally tubular member when the joint members are juxtaposed, and (f) a nut and bolt joins the connector formed by the two third portions to the fourth tubular member.

13. A joint as defined in claim 12, wherein a second clamp is effective to pass around the two third portions of the juxtaposed joint members, said bolt passes through the second clamp, through the adjoining regions of the third portions, and through a flattened end portion of the fourth tubular member.

14. A joint as defined in claim 13, wherein the bolt has a shank with a non-threaded end having a square cross-section, and said second clamp has a hole with a cross-section similar to said bolt.

15. A joint as defined in claim 1, wherein each joint member has an end face with a peg and a matching hole to facilitate alignment of the joint members when juxtaposed.

16. A joint assembly for joining together three tubular members composed of a compound-braced strut including first and second parallel tubular booms braced together by a series of cross pieces, said joint assembly comprising:

(a) a first joint to join together the first booms of the struts, (b) a second joint to join together the second booms of the struts, (c) the first joint including first and second joint members and a first clamp for holding the first and second joint members together, (d) each of the first and second joint members having first and second portions, (e) the first portion of each of the first and second joint members being a telescopic fit within a respective one of the first booms of the first and second struts, (f) the second portions of the first and second joint members together form a first connector when the first joint members are juxtaposed, (g) the first clamp is effective to pass around the second portions of the juxtaposed first and second joint members, (h) the second joint including third and fourth joint members and a second clamp for holding the third and fourth joint members together, (i) each of the third and fourth joint members having first and second portions, (j) the first portion of each of the third and fourth joint members being a telescopic fit within a respective one of the second booms of the first and second struts, (k) the second portions of the third and fourth joint members together form a second connector when the second joint members are juxtaposed, (l) the second clamp is effective to pass around the two second portions of the third and fourth joint members.

17. A joint as defined in claim 16, wherein a strut connects the first joint member of the first joint to the third joint member of the second joint, and